US005386812A

United States Patent [19]

Curran et al.

[11] Patent Number: 5,386,812

[45] Date of Patent: Feb. 7, 1995

[54] METHOD AND SYSTEM FOR MONITORING EVAPORATIVE PURGE FLOW

[75] Inventors: Patrick J. Curran, Farmington Hills; Paul M. Niessen, Canton; Bryce A. Schwager, Ypsilanti, all of Mich.

[73] Assignee: Ford Motor Company, Dearborn, Mich.

[21] Appl. No.: 138,111

[22] Filed: Oct. 20, 1993

[51] Int. Cl.[6] ..... F02M 33/02

[52] U.S. Cl. ..... 123/520

[58] Field of Search ..... 123/516, 518, 519, 520, 123/198 D

[56] References Cited

U.S. PATENT DOCUMENTS

| | | | |
|---|---|---|---|
| 4,949,695 | 8/1990 | Uranishi et al. | 123/520 |
| 5,085,197 | 2/1992 | Mader et al. | 123/520 |
| 5,113,834 | 5/1992 | Aramaki | 123/520 |
| 5,139,001 | 8/1992 | Tada | 123/520 |
| 5,150,689 | 9/1992 | Yano et al. | 123/520 |
| 5,178,117 | 1/1993 | Fujimoto et al. | 123/520 |
| 5,216,995 | 6/1993 | Hosoda et al. | 123/520 |
| 5,216,998 | 6/1993 | Hosoda et al. | 123/520 |
| 5,243,944 | 9/1993 | Blumenstock | 123/520 |
| 5,245,975 | 9/1993 | Ito | 123/520 |
| 5,263,461 | 11/1993 | Fujimoto et al. | 123/520 |

*Primary Examiner*—Raymond A. Nelli
*Assistant Examiner*—Thomas N. Moulis
*Attorney, Agent, or Firm*—Roger L. May; Peter Abolins

[57] ABSTRACT

An evaporative purge flow monitoring system is provided for use in a motor vehicle having a fuel tank and an internal combustion engine having an intake manifold. The purge flow monitoring system includes an evaporation canister in fluid communication with the fuel tank and a canister purge valve in fluid communication with the fuel tank and evaporation canister. A thermistor/resistor network is further provided in fluid communication with the canister purge valve and the intake manifold. An electronic engine control (EEC) assembly is similarly provided in electrical communication with the canister purge valve and the thermistor/resistor network such that the EEC is adapted to determine the voltage difference across the thermistor/resistor network resulting from discrete measurements within the canister purge valve duty cycle during a selected window of operation and compare the determined voltage difference to a calibrated difference so as to detect malfunctions of the canister purge valve.

2 Claims, 4 Drawing Sheets

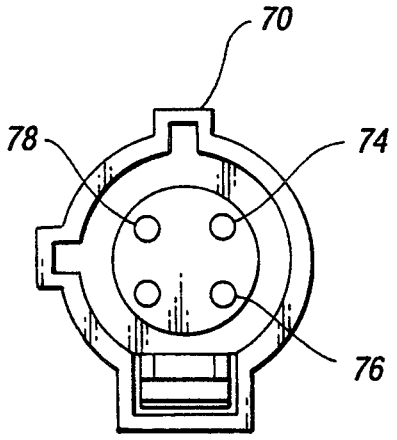
Fig. 5
Fig. 6
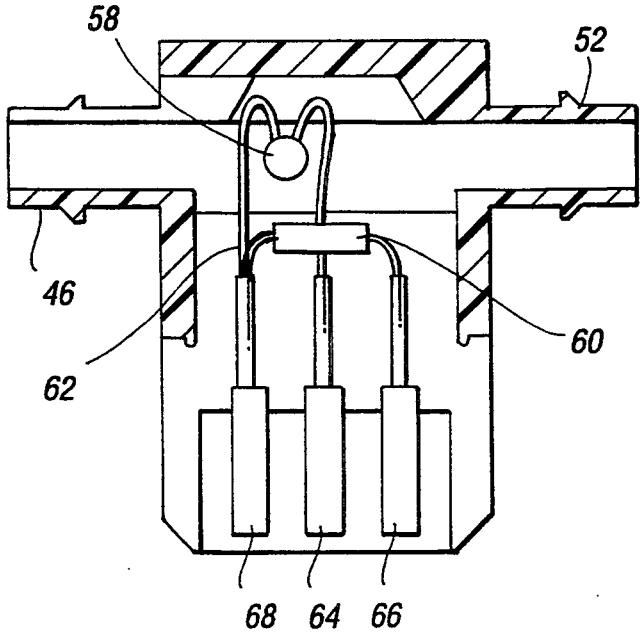
Fig. 8
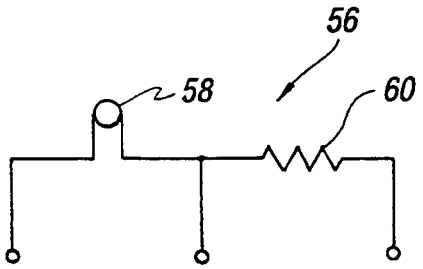

METHOD AND SYSTEM FOR MONITORING EVAPORATIVE PURGE FLOW

TECHNICAL FIELD

The present invention relates generally to fuel tank ventilation systems and, more particularly, to a method and on-board diagnostic system for detecting evaporative fuel vapor purge flow in a motor vehicle for the purpose of determining whether the purge system is functioning properly.

BACKGROUND OF THE INVENTION

Evaporative emission control systems are widely used in Internal Combustion Engine (ICE) powered motor vehicles to prevent evaporative fuel, i.e. fuel vapor, from being emitted from the fuel tank into the atmosphere. There are generally three main components that control such evaporative emission operations: carbon canister vent valves and canister purge valves (both vacuum-operated and electronically operated). One or more of the above components may typically be found in an ICE powered motor vehicle to control evaporative emission.

The most common valve used to control evaporative emission operation is the canister purge solenoid, which is a normally closed solenoid that is mounted in line between a carbon canister and the intake manifold of an internal combustion engine. In operation, when the Electronic Engine Control (EEC) assembly energizes the solenoid, the solenoid opens, thus allowing the intake manifold vacuum to draw fuel vapors from the canister into the cylinders for combustion. In contrast, when the electronic control assembly de-energizes the solenoid, fuel vapors are stored in the carbon canister.

As readily seen, in the event that one or more of the above evaporative emission control components malfunctions, fuel vapors may be vented improperly resulting in reduced engine performance and possible release of vapors into the atmosphere. It is thus desirable to employ an on-board diagnostic system capable of detecting deficiencies in evaporative vapor emission control components and identifying such deficiencies so that corrective measures may be taken.

One such attempt is disclosed in U.S. Pat. No. 5,085,197, issued to Mader et al, entitled "Arrangement for the Detection of Deficiencies in a Tank Ventilation System." As reflected in the title, the U.S. Pat. No. 197 discloses a system for the detection of defects in a tank ventilation system formed of a fuel tank, an active carbon filter, a control unit, a lambda probe, a tank ventilation valve (canister purge solenoid), and a flow sensor. In operation, the control unit examines signals arriving from the lambda probe and from the flow sensor along with the outgoing tank ventilation control signals to generate an error signal indicative of a defect in the ventilation system such as a malfunctioning valve and/or a leak in one or more of the connecting hoses.

Significantly, the U.S. Pat. No. 197 discloses a ceramic PTC resistor for use as a flow sensor. Such resistors are particularly known to be affected by changes in temperature gradient, engine load and engine speed. While the U.S. Pat. No. 197 does disclose temperature compensation means to ensure readings are taken under similar ambient conditions, the remaining engine parameters are neither addressed nor compensated for. As a result, variations in engine speed or engine load may substantially alter the information received and thus produce a false or erroneous error signal.

SUMMARY OF THE INVENTION

It is thus a general object of the present invention to overcome the limitations of the prior art by providing a method and system for accurately monitoring evaporative purge flow, which compensates for variations in ambient temperature, vehicle speed engine load and inferred manifold vacuum.

A more specific object of the present invention is the provision of a method and system for detecting malfunctions in a tank ventilation network which is operable in cooperation with a canister purge valve.

In carrying out the above objects, the system of the present invention is provided for use in an ICE powered motor vehicle having a fuel tank and an internal combustion engine having an intake manifold. The system includes an evaporation canister in fluid communication with the fuel tank and a canister purge valve in fluid communication with the fuel tank and the evaporation canister. There is further provided a flow sensor comprising a thermistor/resistor network in fluid communication with the canister purge valve and the intake manifold. Finally, an Electronic Engine Control (EEC) assembly is provided in electrical communication with the canister purge valve and the thermistor/resistor network.

In operation, the electronic engine control assembly is adapted to determine the voltage difference across the thermistor/resistor network resulting from discrete measurements taken within the canister purge valve duty cycle during a selected window of operation, i.e. during a selected range of ambient temperature, engine load vehicle speed and inferred manifold vacuum. This determined voltage difference is compared within the EEC to a calibrated voltage difference (corresponding to a desired purge flow) and used to generate an error or warning signal in accordance with selected logic.

The method of the present invention is similarly provided for use in an ICE powered motor vehicle having a fuel tank, an evaporation canister, an internal combustion engine having an intake manifold, and a canister purge valve all in fluid communication, as well as an electronic engine control assembly in electrical communication with the canister purge valve. The method steps include the provision of a thermistor/resistor network in fluid communication with the canister purge valve and the intake manifold and in electrical communication with the EEC. As referenced above, in operation, the voltage across the thermistor/resistor network is measured at discrete intervals within a canister purge valve duty cycle and further within a selected range of engine load, vehicle speed, inferred manifold vacuum and ambient air temperature. Thereafter, the difference between the measured thermistor/resistor network voltages is determined and compared to a calibrated voltage difference corresponding to a predetermined purge flow. Finally, malfunctions in the canister purge valve are indicated if the determined voltage difference is less than the calibrated voltage difference.

In contrast to the disclosure of the U.S. Pat. No. 197, the present invention does not utilize a lambda probe to test for vapor content. Rather, the present invention looks for a purge flow above a threshold value in a specified window of operation, i.e. engine load, engine speed and ambient temperature. The present invention is operable regardless if air or vapor passes through the flow sensor. Similarly, the present invention is operable regardless if the evaporation canister is empty or saturated.

The objects, features and advantages of the present invention are readily apparent from the following detailed description of the best modes for carrying out the invention when taken in connection with the accompanying drawings.

BRIEF DESCRIPTION OF THE DRAWINGS

FIG. 5 is a right plan view of a harness connector adapted for use with the flow sensor of FIGS. 2–4;

FIG. 6 is a cross-sectional view along lines a—a of the flow sensor shown in FIGS. 2–4;

FIG. 8 is an electrical circuit diagram of the flow sensor shown in FIGS. 1–4.

BEST MODES FOR CARRYING OUT THE INVENTION

Figure 1:
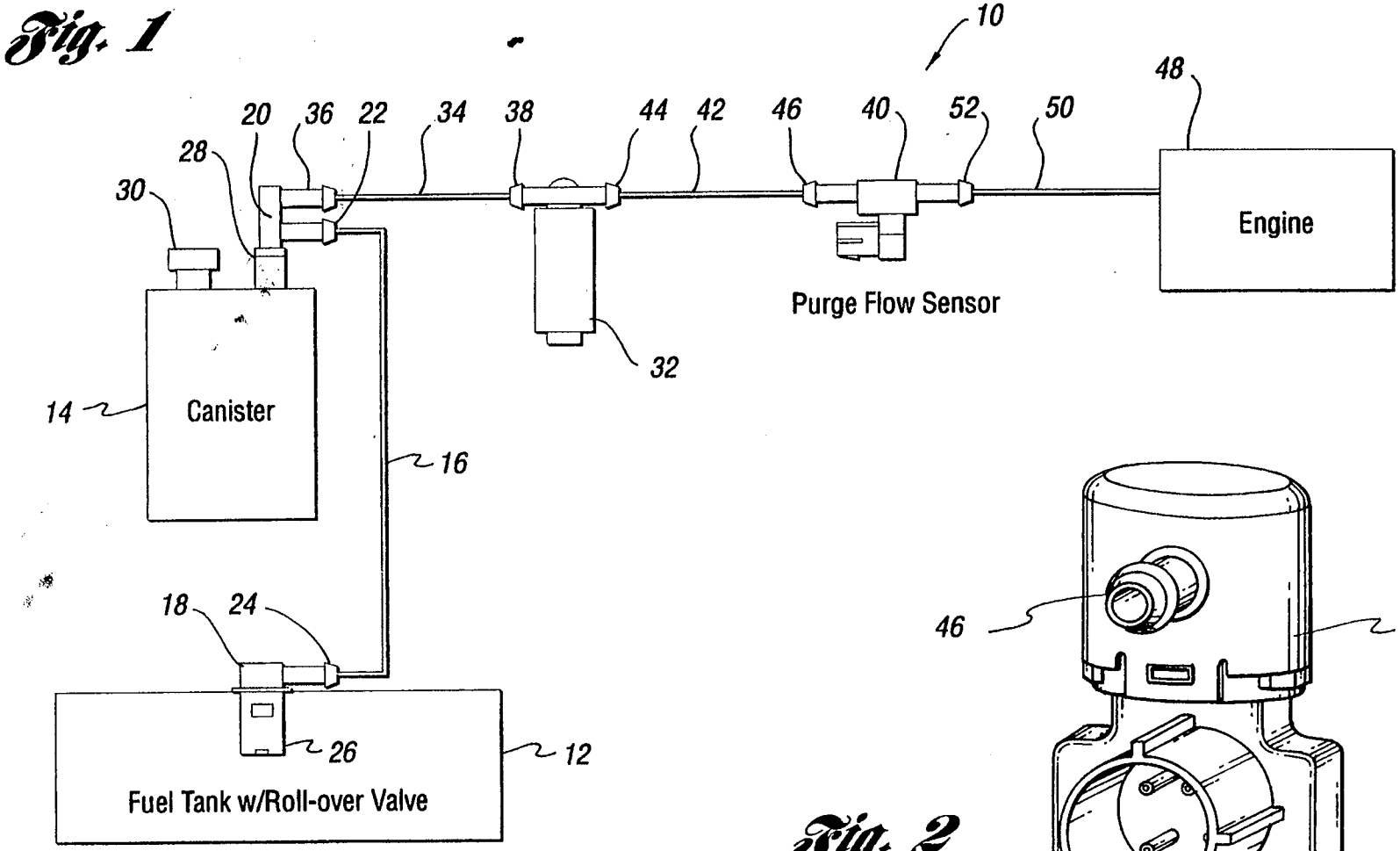
FIG. 1 is a schematic diagram of the evaporative purge flow monitoring system of the present invention.
Figure 2:
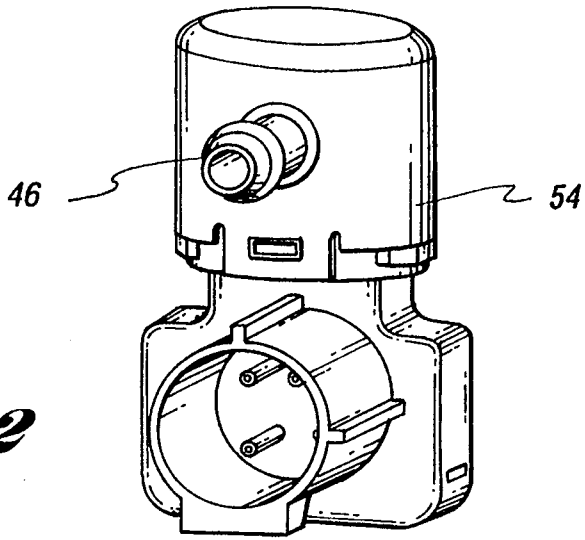
FIG. 2 is a perspective view of the flow sensor incorporated in the evaporative purge flow monitoring system of the present invention.
Figure 3:
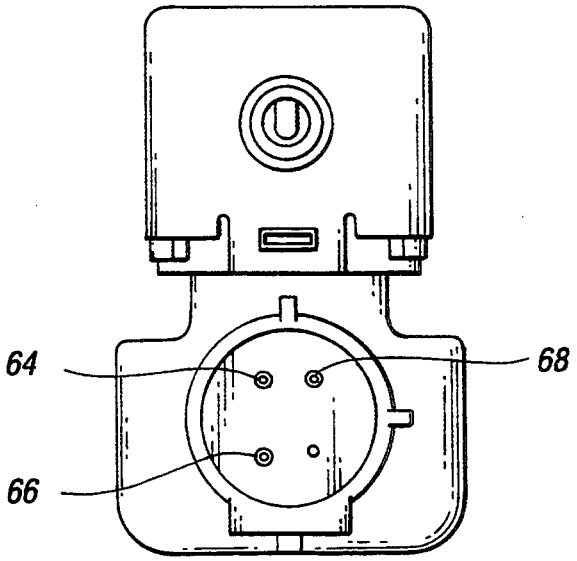
FIG. 3 is a right plan view of the flow sensor shown in FIG. 2.
Figure 4:
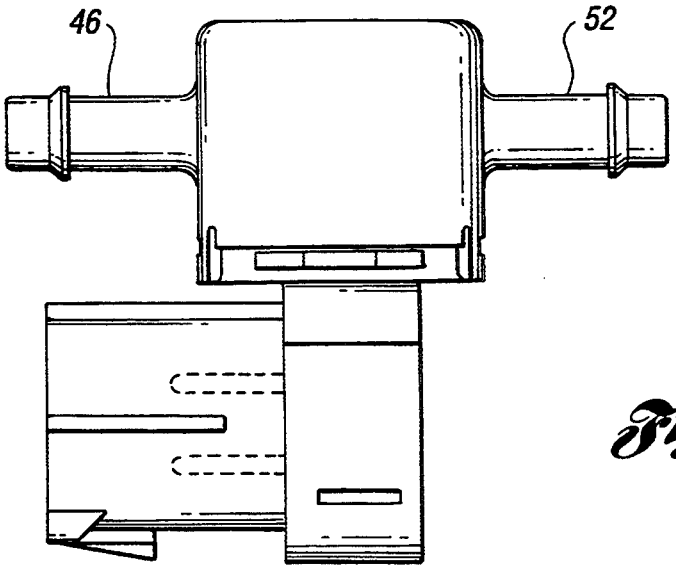
FIG. 4 is a front plan view of the flow sensor shown in FIGS. 2 and 3.

With reference to FIG. 1 of the drawings, there is provided a schematic diagram of the evaporative purge flow monitoring system of the present invention designated generally by reference numeral 10. As shown, system 10 includes a fuel tank 12 provided in fluid communication with vapor retention means such as evaporation canister 14, through hose 16 or similar leak-proof conduit. As seen, hose 16 is affixable at opposing ends to vapor purge connectors 18 and 20, and in particular, nipples 22 and 24. Vapor purge connector 18 is similarly shown as affixable to a roll-over valve 26, which is provided in fluid communication with fuel tank 12.

Still referring to FIG. 1, evaporation canister 14 includes an atmospheric vent 30 as well as a nipple 28 which is adapted to receive vapor purge connector 20. Fuel tank 12 may also contain a vacuum relief valve (not shown) in the fuel tank cap (not shown). As seen, evaporation canister 14 is provided in fluid communication with canister purge valve 32 via hose 34 which is affixable to the secondary vapor purge connector nipple 36 and a first vapor purge connector nipple 38. In turn, canister purge valve 32 is provided in fluid communication with purge flow sensor 40 through hose 42 which is affixable at opposite ends to nipples 44 and 46. Finally, purge flow sensor 40 is provided in fluid communication with the intake manifold (not shown) of internal combustion engine 48 through hose 50 which is affixable at opposite ends to purge flow sensor nipple 52 and a corresponding nipple of the intake manifold (not shown).

In keeping with the invention, purge flow sensor 40 is disposed in line and thus in fluid communication with both the canister purge flow valve 32 and internal combustion engine 48. Significantly, purge flow sensor 40 is also disposed on the downward end or vapor emitting end of closed canister purge valve 32. In the preferred embodiment, canister purge valve 32 comprises a normally closed solenoid which is energized by the Electronic Engine Control (EEC) assembly of the vehicle. When solenoid 32 opens, it allows the vacuum of the intake manifold of internal combustion engine 48 to draw fuel vapors from evaporation canister 14 for combustion in the cylinders. In contrast, when the electronic control assembly de-energizes the solenoid 32, fuel vapors are stored in the evaporation canister.

While the preferred embodiment of canister purge valve 32 comprises a solenoid, applicants recognize that in certain applications, a vacuum-operated purge valve may be utilized, for example, certain applications may require a heat control solenoid for controlling vacuum-operated purge valves. As those skilled in the art will recognize, heat control solenoids operate much like normally closed exhaust gas recirculation solenoids. In operation, heat control solenoids thus control purge valves during warm engine operation and control exhaust heat control valves during cold engine operation.

Significantly, in the preferred embodiment, the purge flow detection system of the present invention is designed to take two flow readings, i.e. 100% purge and 0% purge, within the selected window of operation. It should be understood that references to the previous state of manifold vacuum and purge valve are necessary because the response of the flow sensor and, in particular, the PTC thermistor, is not instantaneous. Also, if a load or vehicle speed window is violated at any time while the test is running, the test must be aborted and attempted when the entry conditions are again valid. In the preferred embodiment, the test is conducted once per trip and two successive malfunction indications will provide a warning or "check engine" signal.

With reference now to FIGS. 2–8, the structure of purge flow sensor 40 will be described in further detail. As shown, purge flow sensor 40 comprises a housing 54 having vapor purge connectors 46 and 52 which are provided in fluid communication with purge valve 32, evaporation canister 14, and internal combustion engine 48, respectively. Disposed internally within housing 54 is a thermistor/resistor network as shown in FIG. 8 which is designated generally by reference numeral 56. This network comprises a ceramic PTC thermistor 58 connected in series electrical communication with a resistor 60 through insulated leads 62. In the preferred embodiment, resistor 60 has a 17 Ω impedance. As readily apparent to those skilled in the art, thermistor/resistor network 56 functions as a voltage divider. More specifically, resistor 58 acts as a current limiter to provide stability and safety to the thermistor/resistor network.

Still referring to FIGS. 2–8, thermistor/resistor network 56 is shown in electrical communication with a plurality of connecting pins 64, 66 and 68 corresponding, respectively, to the power, ground and the electronic engine control (EEC) assembly. Pins 64, 66 and 68 are adapted to be removably connected to harness connector 70 which, as shown in FIG. 5, has corresponding connectors 72, 74 and 76 adapted to receive pins 64, 66 and 68. As those skilled in the art will recognize, harness connector 70 is affixed to a wiring harness (not shown) which connects all electrical components of the motor vehicle to the EEC.

OPERATION OF THE FLOW SENSOR

Figure 7:
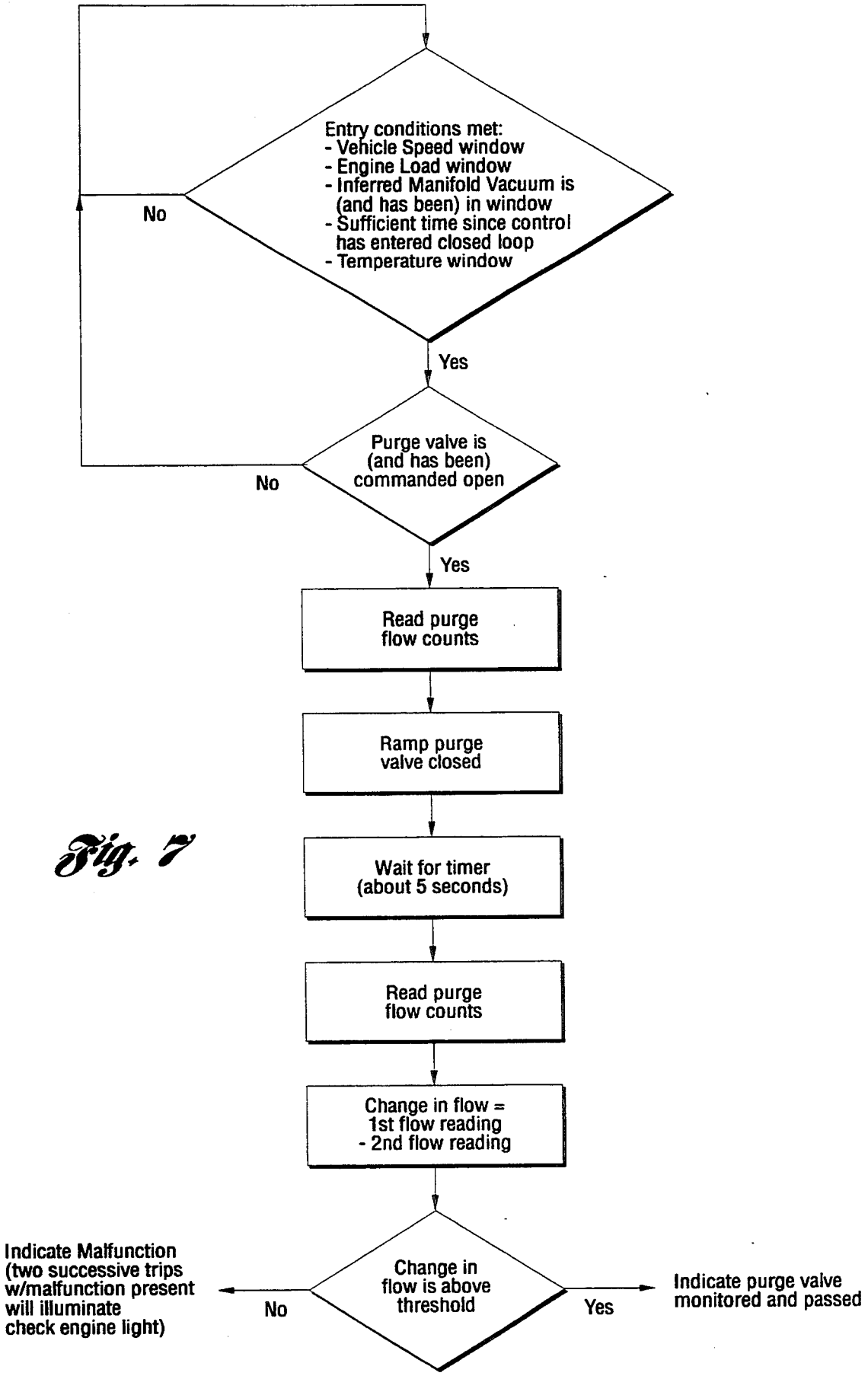
FIG. 7 is a flow chart of the method steps of the present invention.

With reference now to the flow chart of FIG. 7, the method steps of the evaporative purge flow detection system of the present invention will now be described in further detail. As indicated above, PTC thermistor 58, which is incorporated as part of purge flow sensor 40, is a heated device whose impedance changes when air flows across it, using the principle of convection. Thus, changes in purge flow will affect the voltage across the thermistor and, in turn, across the series resistor 60.

To ensure adequate readings, the detection system of the present invention is therefore designed to be operable only within a specified window or range of engine load, (inferred manifold vacuum), ambient air temperature, and vehicle speed. The requirement of an operation window is to compensate for false error signals which might be generated in the event substantial changes in engine load occurred between flow sensor measurements. More specifically, it should be understood that the purge flow sensor incorporated in the detection system of the present invention is designed to measure voltage across series resistor 60 when purge valve 32 is in an open position (100% purged) and at a later time after valve 32 has been forced closed. By looking at purge values above a threshold level, the evaporative purge flow detection system of the present invention can make determinations if canister purge valve 32 is operating properly. These purge levels, reflected in voltage measurements across series resistor 60, and more specifically, in digital counts, are affected by changes in engine conditions which are, of course, constantly varying. For example, those skilled in the art will recognize that inferred manifold vacuum is inversely proportional to engine load. Thus, the measured voltage across resistor 60 will decrease as engine load increases, if purge valve 32 is open. If these characteristics are graphed, the resultant voltages would converge, thus exhibiting a gray area wherein false error signals may be generated. To compensate for these varying engine condition changes and, in particular, varying engine load, the evaporative purge flow detection system of the present invention is designed to operate only within a specified range of engine load, ambient air temperature, and vehicle speed and inferred manifold vacuum.

In operation, when these parameters have been met as specified by the EEC, purge valve 32 is retained in an open position and the analog voltage across series resistor 60 is measured at 100% purge. This voltage is thereafter converted to a first flow reading in digital counts. Thereafter, canister purge valve 32 is ramped closed over a selected time delay, preferably 5 seconds, so as not to have any significant effect on the operation of the internal combustion engine.

As those skilled in the art will recognize, an instantaneous shut-off of purge valve 32 may result in undesirable effects on the operation of the internal combustion engine. Once canister purge valve 32 has been ramped closed, the analog voltage across series resistor 60 is again measured, this time at 0% purge. The voltage is once again converted to a second flow reading in digital counts. Thereafter, the digital count difference between the first and second flow readings is determined and compared to the calibrated count difference corresponding to a predetermined purge flow. If the determined count difference is less than the calibrated count difference, an indication is provided to the system.

While the best mode for carrying out the invention has been described in detail, those familiar with the art to which this invention relates will recognize various alternative designs and embodiments for practicing the invention as defined by the following claims.

We claim:

1. For use in a motor vehicle having a fuel tank, an evaporation canister, an internal combustion engine having an intake manifold, and a purge solenoid all in fluid communication, and an Electronic Engine Control (EEC) assembly in electrical communication with said purge solenoid, a method of determining malfunctions in said purge solenoid, comprising:

providing a thermistor circuit in fluid communication with said purge solenoid valve and said intake manifold and in electrical communication with said EEC, said thermistor circuit including a ceramic PTC thermistor in series electrical communication with a resistor;

retaining said purge solenoid in an open position;

measuring the analog voltage across said series resistor at 100% purge within a selected range of engine load, inferred manifold vacuum, vehicle speed and ambient air temperature and converting said analog voltage to a first flow reading in digital counts;

ramping said purge solenoid closed over a selected time delay;

measuring the analog voltage across said series resistor at 0% purge within said selected range of engine load, inferred manifold vacuum, vehicle speed and ambient air temperature and converting said analog voltage to a second flow reading in digital counts;

determining the digital count difference between said first and second flow readings;

comparing said determined count difference to a calibrated count difference corresponding to a predetermined purge flow; and indicating determined malfunctions in said purge solenoid if said determined count difference is less than said calibrated count difference.

2. The method of claim 1, wherein said calibrated count difference is approximately 100 counts.

* * * * *